US006059619A

United States Patent [19]

Nozue

[11] Patent Number: 6,059,619

[45] Date of Patent: May 9, 2000

[54] COOLING ARRANGEMENT FOR OUTBOARD MOTOR

[75] Inventor: Toshihiro Nozue, Hamamatsu, Japan

[73] Assignee: Sanshin Kogyo Kabushiki Kaisha, Japan

[21] Appl. No.: 09/107,822

[22] Filed: Jun. 30, 1998

[30] Foreign Application Priority Data

Jun. 30, 1997 [JP] Japan ..... 9-173611

[51] Int. Cl.[7] ..... B63H 21/38

[52] U.S. Cl. ..... 440/88; 440/89

[58] Field of Search ..... 440/88, 89; 123/196 W

[56] References Cited

U.S. PATENT DOCUMENTS 3,961,595 6/1976 Meyer ..... 440/89

4,684,351 8/1987 Watanabe et al. ..... 440/89

*Primary Examiner*—Sherman Basinger

*Attorney, Agent, or Firm*—Knobbe, Martens, Olson & Bear, LLP

[57] ABSTRACT

An improved and simplified outboard motor construction wherein the exhaust system for the engine is formed with a minimum number of components and sealing joints. The exhaust system includes an elongated expansion chamber formed in the drive shaft housing. In addition, the drive shaft housing has a cylindrical section that is journaled within a swivel bracket for its steering movement. The volume between the external portion of the drive shaft housing and the internal portion of the swivel bracket forms a second expansion chamber that is employed for the low speed above the water exhaust gas discharge. The flow of cooling the water to and from the engine is controlled so that the exhaust gas interchange area between the power head and the drive shaft housing will be well cooled, as will the oil reservoir for the engine.

15 Claims, 9 Drawing Sheets

COOLING ARRANGEMENT FOR OUTBOARD MOTOR

BACKGROUND OF THE INVENTION

This invention relates to an exhaust arrangement for outboard motors and more particularly to an improved arrangement for cooling various components in an outboard motor.

As is well known, an outboard motor consists substantially of a self contained power plant that can be attached to the hull of a watercraft for propelling it through a body of water. As a result, the outboard motor includes a prime mover, normally an internal combustion engine, a propulsion device and a transmission for driving the propulsion device.

Generally, the engine is positioned in the power head at the top of the drive shaft housing and is supported so that its output shaft rotates about a vertically extending axis. This permits coupling of the engine output shaft to a drive shaft that depends into the drive shaft housing and which drives a propulsion device in a lower unit through a transmission. Frequently, these transmissions are capable of shifting between forward and reverse conditions.

The outboard motor also includes a supporting arrangement between the coupling to the watercraft hull and the propulsion unit so that the propulsion unit can be steered generally about a vertically extending axis and to achieve tilt and trim movement generally about a horizontal axis.

Furthermore, the outboard motor must include an arrangement for facilitating cooling of the engine, induction of air charge to the engine and discharge of the exhaust gases to the atmosphere including a silencing arrangement. In the instance of four cycle engines, there is also the problem of providing a stable oil reservoir for the engine lubricant and one in which the oil will not become heated and preferably is cooled. This latter function is one that provides substantial problems.

That is, in many applications for engines other than in marine applications, there is substantial space available for the exhaust system. The exhaust system for any engine should generally permit efficient flow of the exhaust gases to the atmosphere and also provide silencing and cooling of the exhaust gases so as to be relatively unobjectionable in noise and effect on the atmospheric conditions.

With an outboard motor, the space available for this exhaust treatment is relatively limited. Generally, outboard motors include in the engine some form of internal exhaust manifold through which the exhaust gases are passed from the combustion chamber to the exhaust system of the outboard motor. Generally, the exhaust system includes an expansion chamber that is formed in the drive shaft housing and an exhaust pipe arrangement for delivering the exhaust gases from the engine manifold to the expansion chamber.

The expansion chamber then discharges the exhaust gases to the atmosphere, generally through an under water high speed exhaust gas discharge. This is done so as to utilize the body of water in which the watercraft is operating as a silencing medium. Under low speed conditions, however, the under water exhaust discharge is relatively deeply submerged and the back pressure on the exhaust gases will not permit them to exit from this path. Therefore, there is normally provided an additional, above the water exhaust gas discharge which functions under this running condition.

With four cycle engines, the oil reservoir may be placed either in the power head or at a high level in the drive shaft housing. If splash lubrication the power head location is almost mandatory. This places it in a position where there is likely to be close proximity to the portions of the exhaust system where the temperature of the exhaust gasses will still be quite high. This means that the oil may become heated rather than cooled.

It is, therefore, a principle object of this invention to provide an improved outboard motor oil reservoir location and arrangement where close proximity to the exhaust system is possible.

As has been previously noted, it is also necessary to employ some form of system for cooling the engine of the outboard motor. Because of the fact that the outboard motor operates in a body of water, it is common to employ water cooling for the engine. This involves drawing water from the body of water in which the watercraft is operating, circulating it through the engine cooling system and discharging it back to the body of water in which the watercraft is operating. In this way, the body of water acts as the heat exchanger for the engine cooling system.

Although this arrangement is quite simple, providing the necessary flow path can be difficult. Furthermore and in accordance with another object of this invention, there is provided a path for the cooling water so that it can also assist in cooling the exhaust gases and the oil reservoir.

SUMMARY OF THE INVENTION

This invention is adapted to be embodied in an outboard motor that is comprised of a power head containing an internal combustion engine and a surrounding protective cowling. A drive shaft housing and lower unit depends from the power head and journals a drive shaft driven by the engine output shaft and a propulsion device for propelling an associated watercraft. The engine is comprised of an engine body that defines a crankcase chamber in which a crankshaft or engine output shaft is rotatably journaled. A cylinder bore is also defined by the engine body and is closed at one end by the crankcase chamber and at the other end by a cylinder head. The cylinder head defines an exhaust passage that terminates in an exhaust port in an outer surface of the engine body. The lower portion of the engine body forms an oil reservoir and an exhaust passage that receives at least some of the exhaust gasses from the cylinder head exhaust passage. The engine body has a cooling jacket extending at least in part around the cylinder bore. Cooling water is delivered to the cooling jacket and discharged at least in part from the cooling jacket through the lower portion of the engine body in proximity to both the oil reservoir and the exhaust passage.

DETAILED DESCRIPTION OF THE PREFERRED EMBODIMENT

Figure 1:
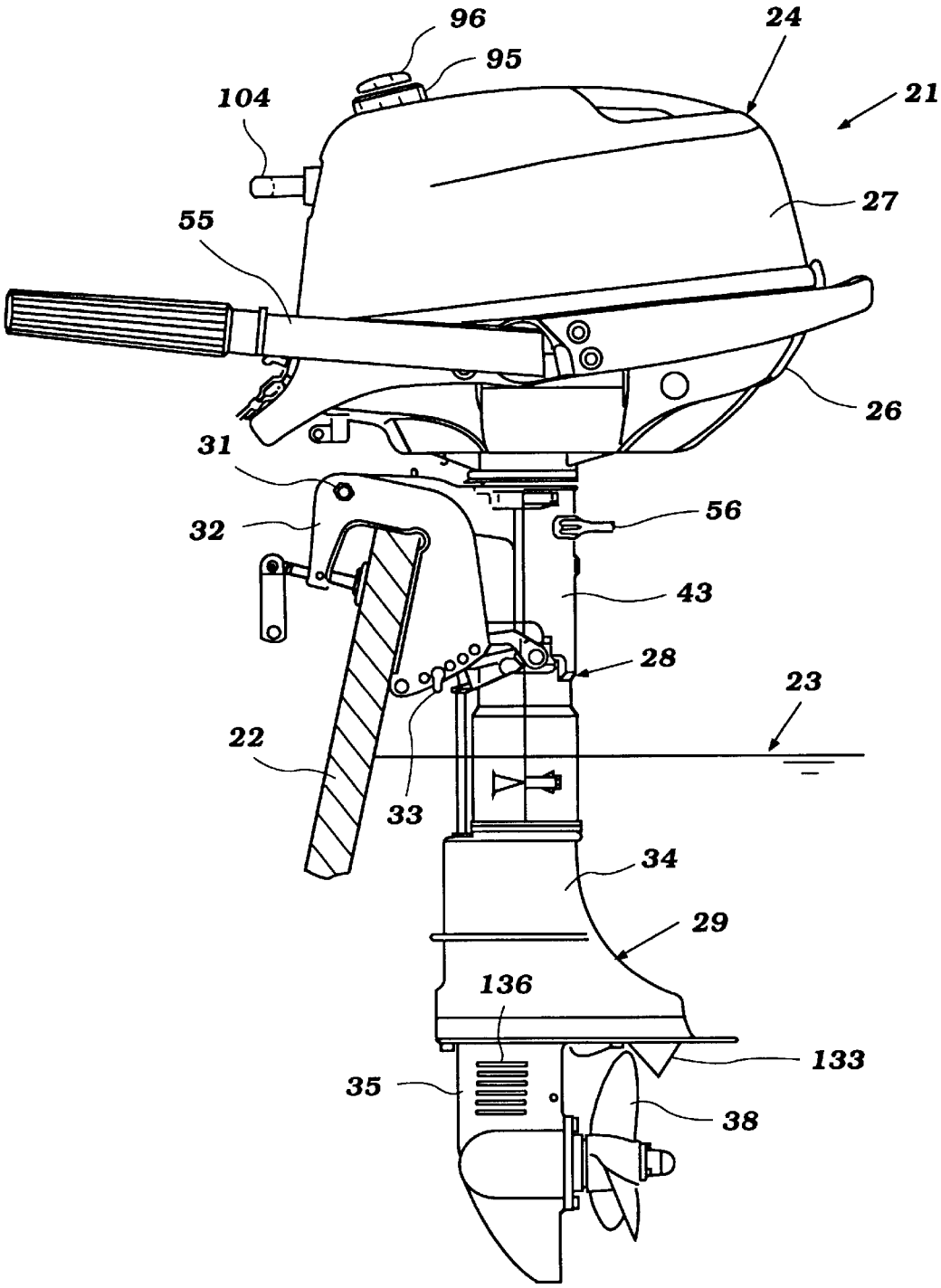
FIG. 1 is a side elevational view of an outboard motor constructed in accordance with an embodiment of this invention, shown attached to the transom of a watercraft, both illustrated in cross-section, and at rest in a body of water in which the watercraft is operating.
Figure 2:
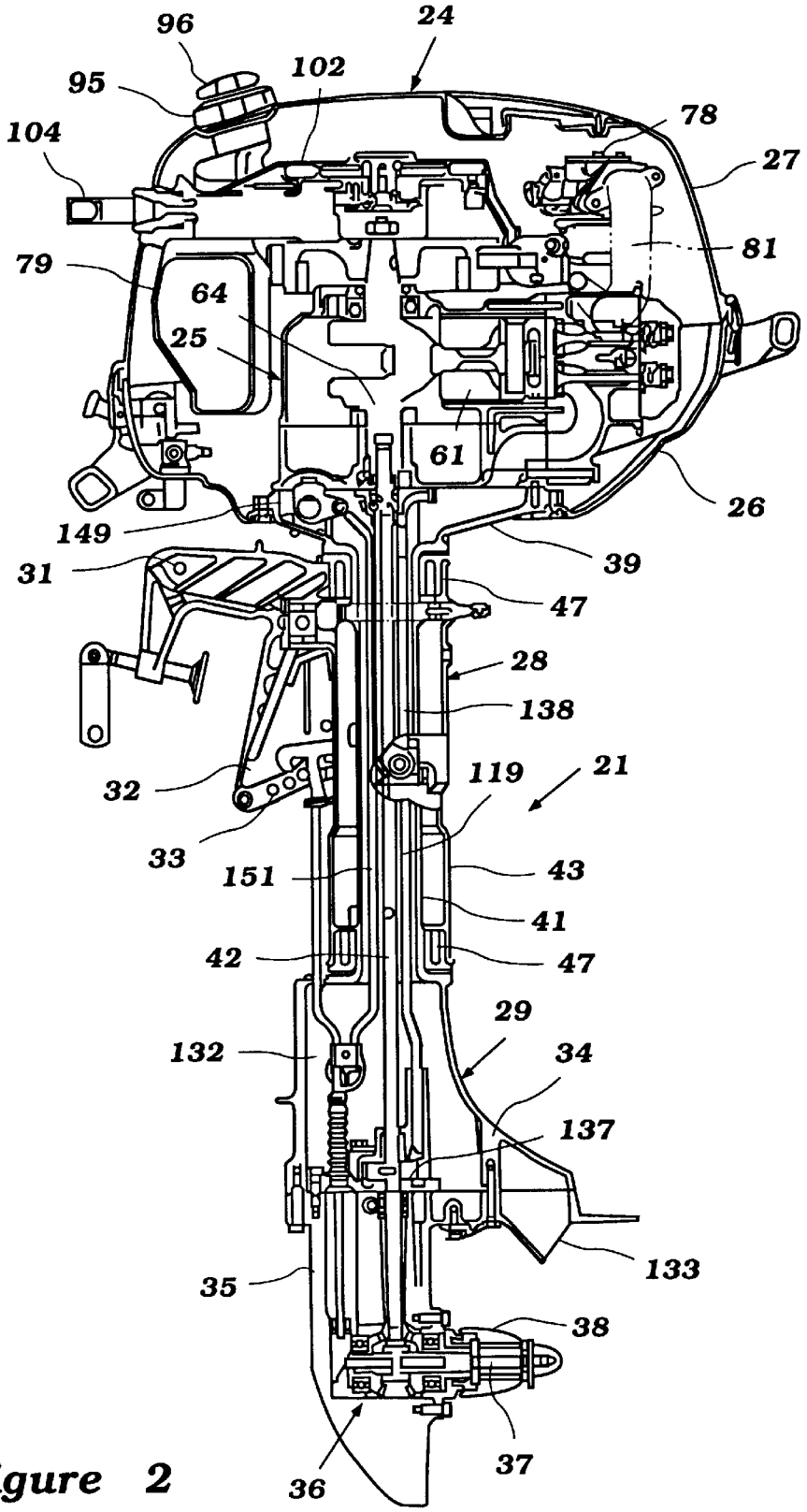
FIG. 2 is a view looking in the same direction as FIG. 1, but shows certain components of the outboard motor broken away and in section.

Referring now in detail to the drawings and initially primarily to FIGS. 1 and 2, an outboard motor constructed in accordance with an embodiment of the invention is identified generally by the reference numeral 21. The outboard motor 21 is shown as being attached to the transom of an associated watercraft. The transom is shown only partially in cross-section and indicated by the reference numeral 22.

The watercraft with which the transom 22 is associated and outboard motor 21 are designed so as to be operated in a body of water, indicated at 23 in FIG. 1. The water level 23 illustrated in FIG. 1 is the water level when the watercraft is relatively stationary. The watercraft is of the planing type and as its speed increases, the degree of submersion of the outboard motor will be reduced, as is well known in this art.

The outboard motor 21 is comprised of a power head portion, indicated generally by the reference numeral 24. The power head portion 24 includes an internal combustion engine, which appears partially in cross-section in FIG. 2 and which is identified by the reference numeral 25. The power head is completed primarily by a protective cowling that is comprised of a lower tray portion 26 and an upper main cowling portion 27.

The outboard motor 21 includes a swivel bracket, indicated generally by the reference numeral 28. This swivel bracket 28 is generally a tubular member which supports a drive shaft housing and lower unit assembly, indicated generally by the reference numeral 29, in a manner to be described. This unit assembly 29 is mounted, in a manner to be described, in the swivel bracket 28 so that it rotatably journals the drive shaft housing and lower unit 29 and thus the outboard motor 21 for steering about a vertically extending axis.

The swivel bracket 28 is, in turn, connected by means of a pivot pin 31 to a clamping bracket 32. This pivotal connection permits tilt and trim adjustment of the outboard motor 21 about the pivot pin 31 relative to the hull transom 22. A trim pin arrangement 33 permits selective setting of the trim angle.

The drive shaft housing and lower unit 29 includes a lower housing portion 34 to which is fixed a lower unit housing 35 that contains a conventional bevel gear reversing transmission, indicated generally by the reference numeral 36. This bevel gear transmission 36 can selectively be coupled to a propeller shaft 37 that is journaled in the lower unit 35 in any suitable fashion. The control for this transmission 36 will be described later, but any known system may be employed. A propeller 38 is affixed to the propeller shaft 37 for propelling the watercraft in a well known manner.

Figure 3:
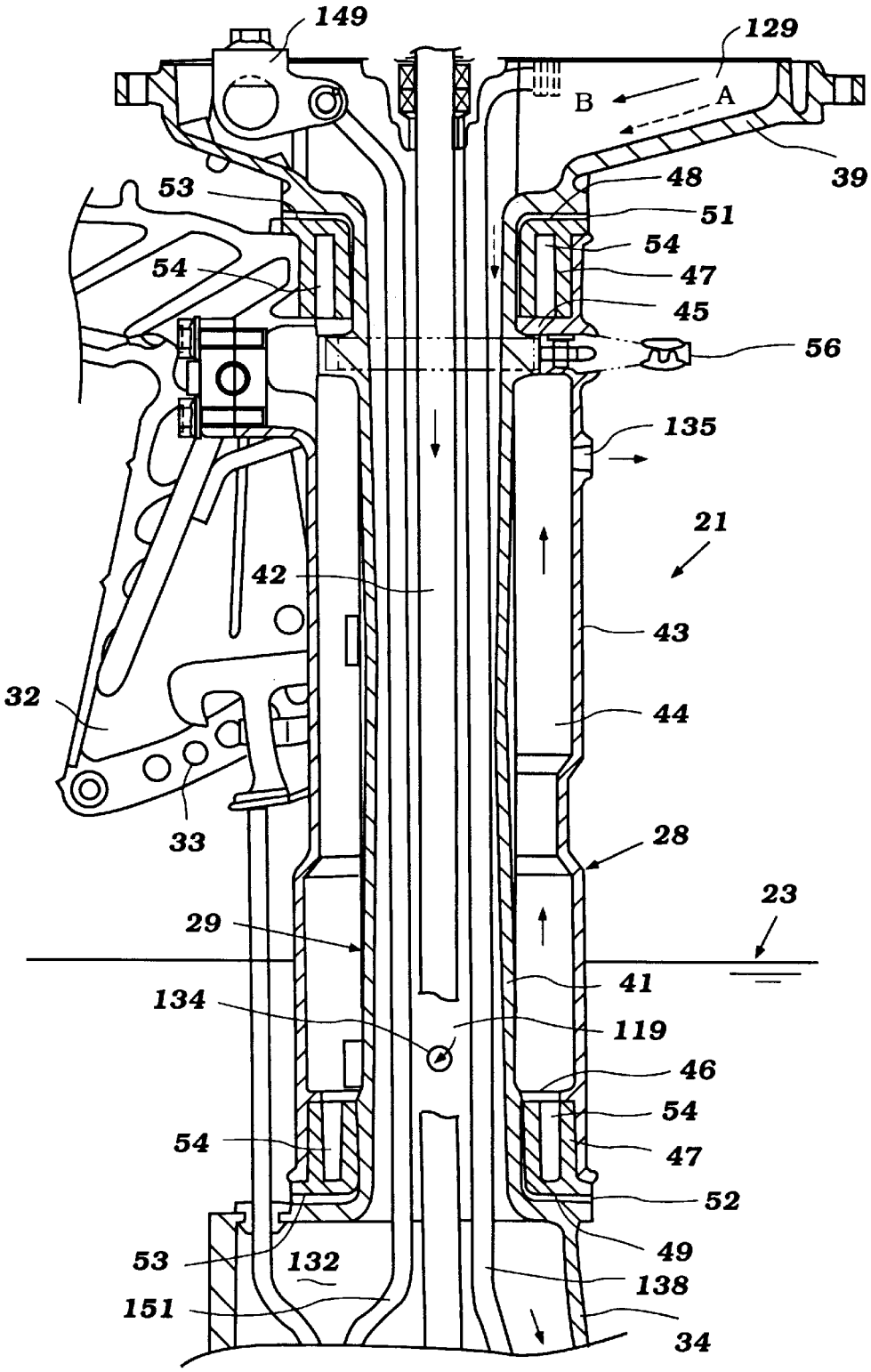
FIG. 3 is an enlarged cross-sectional view of the steering support for the outboard motor and showing a portion of the exhaust system.

The steering support for the outboard motor 21 will now be described in more detail by particular reference to FIGS. 2 and 3. It may be seen in FIGS. 2 and 3 that the drive shaft housing and lower unit 29 is a unitary construction which may be formed from a lightweight material, such as an aluminum alloy or the like. This includes an upper supporting plate portion 39 which is integrally connected to a generally tubular portion 41 that depends downwardly from the powerhead 24 to the lower unit portion 35. A drive shaft 42, which is driven in a manner to be described by the engine 25, extends through this tubular portion 41 and has a bevel gear affixed to its lower end which forms a portion of the bevel gear reversing transmission 36.

The swivel bracket 28 is of a longitudinally split, two-piece construction and has a generally vertically extending cylindrical portion 43 that embraces the drive shaft housing cylindrical portion 41, but is radially spaced outwardly therefrom so as to define an expansion chamber area 44 therebetween, for a purpose which will be described.

This two-piece outer construction defines an upper shoulder 45 and a lower shoulder 46 which extend radially inwardly toward the drive shaft housing tubular portion 41. Split elastic supporting members 47 are interposed between these shoulders 45 and 46 and a downwardly facing shoulder 48 of the upper support plate portion 39 of the drive shaft housing and a lower, upwardly facing shoulder 49 formed at the upper end of the lower drive shaft housing portion 34.

These elastic supporting members 47 are split so as to be inserted around the drive shaft housing cylindrical portion 41 at the upper and lower ends thereof. Split nylon bushings 51 and 52 are placed between the upper and lower ends of these members 47 and the drive shaft housing shoulder 48 and 49, respectively.

The elastic members 47 have face portions 53 that are engaged with the respective bushings 51 and 52. A plurality of lightening holes 54 are formed in the hub portion of the elastic members 47 so as to provide lightening and to increase their resilience.

When the swivel housing 48 is placed together in embracing relationship around these nylon bushings and the elastic members 47, there will be provided an effective journaling of the drive shaft housing 29 in the swivel bracket 28 with gas tight seals formed at opposite ends of the expansion chamber 44 for a purpose which will be described.

A tiller 55 (FIG. 1) is affixed suitably to the tray member 26 of the protective cowling of the powerhead 24 for steering of the outboard motor 21 about the vertically extending axis formed by the swivel bracket 28. In addition, a steering lug 56 may be connected to an upper portion of the drive shaft housing tubular portion 41 for connection to a remote steering mechanism for steering of the outboard motor 21 from a remote location. The swivel bracket 28 and specifically its housing member 43 is provided with a slot so as to accommodate this steering motion.

The construction associated with the powerhead 24 will now be described by particular reference to FIGS. 2 and 4 through 7. Referring first to the engine 25, its internal construction is shown best in FIG. 4 and will be described by principle reference to that figure. The engine 25 is comprised of an engine body having three main portions. These comprise a cylinder block portion 57, a cylinder head portion 58, and a oil reservoir forming portion 59. These portions are connected together in a manner which will be described.

The cylinder block 57 defines, in this embodiment, a single horizontally extending cylinder bore 61. One end of this cylinder bore is closed by an upper crankcase chamber 62, that is formed primarily by the lower or forward end of the cylinder block member 57 and which is completed by an oil reservoir forming portion 63 of the oil pan forming member 59. This oil pan forming member 59 is affixed to the lower face of the cylinder block 57 in closing relationship to the cylinder block upper crankcase chamber 62.

A crankshaft 64 is rotatably journaled within the crankcase chamber 62 by means of an upper main bearing 65 that is carried in an upper end face of the cylinder block member 59. In addition, a lower main bearing 66 is carried by the crankcase forming member 59 and journals the lower end of the crankshaft 64. This is in proximity a splined coupling 67 between the crankshaft 64 and the upper end of the drive shaft 42.

Figure 4:
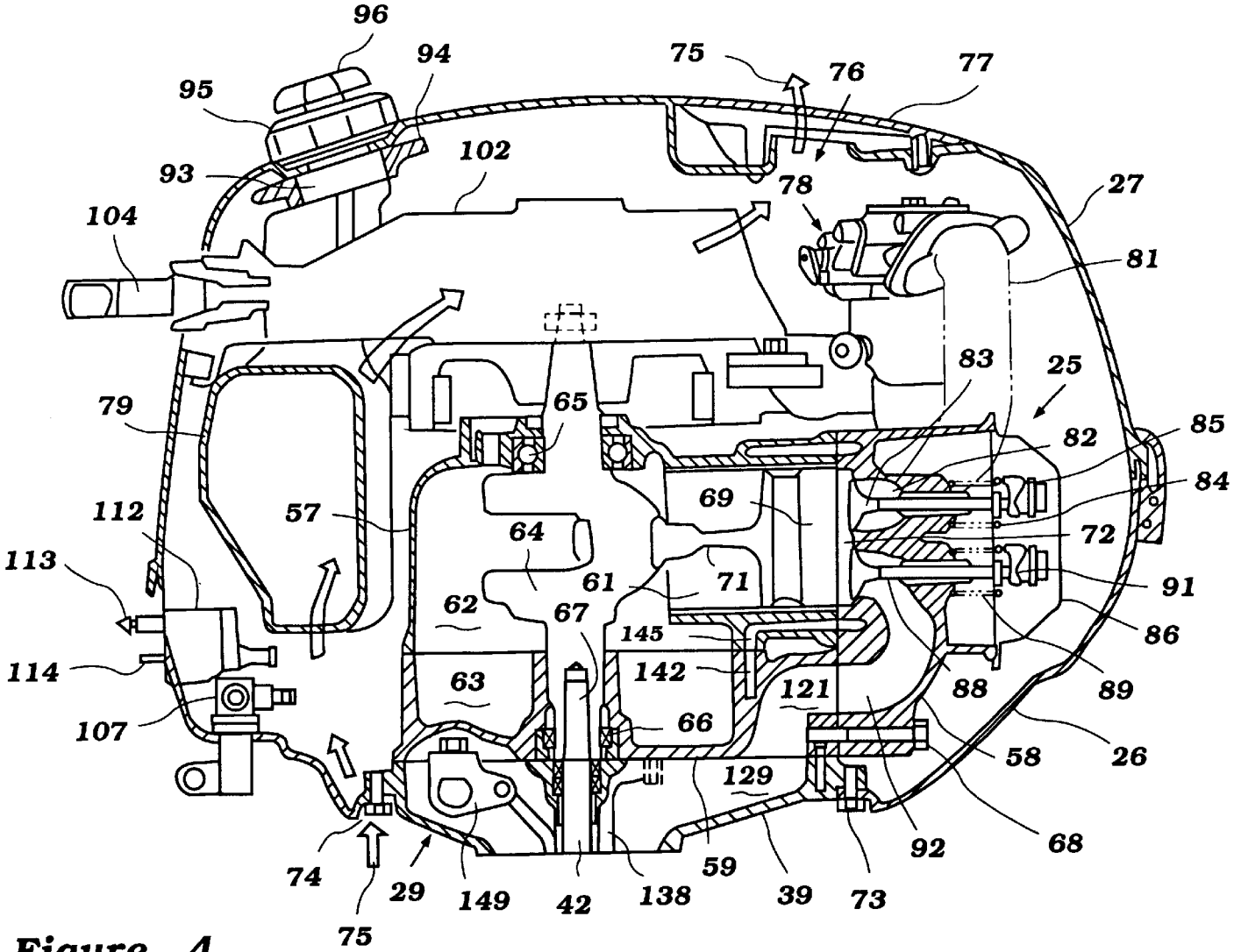
FIG. 4 is an enlarged side elevational view of the power head with portions broken away and shown in section.

The cylinder head 28 is affixed to the crankcase forming member 59 and the cylinder block 57 by means of a plurality of threaded fasteners, one of which appears in FIG. 4 and is identified by the reference numeral 68. Thus, the opposite end of the cylinder bore 61 is closed by the cylinder head member 58.

A piston 69 is supported for reciprocation in the cylinder bore 61. A connecting rod 71 connects the piston 69 to a throw of the crankshaft 64 upon which the connecting rod 71 is journaled in a well known manner.

The surface of the cylinder head member 59 that faces the cylinder bore 61 and which closes it is formed with a recess 72 that forms the combustion chamber of the engine with the piston 69 and the cylinder bore 71. A fuel air charge is delivered to this combustion chamber by an induction system which will now be described, again primarily referring to FIGS. 2 and 4 through 7.

Air for combustion by the engine 25 is admitted to the interior of the protective cowling in a manner which will be described by principle reference first to FIG. 4. First, it should be noted that the tray portion 29 of the protective cowling is affixed to the upper support plate portion 39 of the drive shaft housing 29 by threaded fasteners 73. The lower area of the tray 26 is provided with an air inlet slot 74 so that atmospheric air may be drawn into the interior of the protective cowling in the air manner shown by the arrows 75 in this figure.

The air flows through the interior of the protective cowling and excess air is discharged through an upwardly facing opening 76 formed in the main cowling member 27. The main cowling member 27 is provided with a cover plate 77 that extends across the opening 76 so as to block direct water entry thereto, but which also has slotted openings for exit of the air back to the atmosphere as shown by the arrows 75. Thus, there is provided water separation while permitting adequate air flow for engine combustion and some cooling.

This air is then delivered to a carburetor 78 which may be of any known type. If desired, an air silencer may be affixed to the inlet of the carburetor 78 for silencing the intake air. The carburetor 78 receives fuel from a fuel tank 79 in a manner which will be described shortly.

The carburetor 78 delivers the formed charge of fuel and air to an intake manifold 81 which communicates with an intake passage 82 formed in the cylinder head 58. This intake passage 82 terminates at an intake valve seat which is valved by an intake valve 83. The intake valve 83 is urged to a closed position by a coil compression spring assembly 84 that acts against a keeper retainer assembly fixed to the stem of the intake valve 83 in a well known manner. The intake valve 83 is opened and by a valve actuating mechanism which includes a rocker arm 85 that is pivotally supported in the cylinder head 58. The valve mechanism described is contained in a valve chamber that is closed by a valve cover 86.

Figure 5:
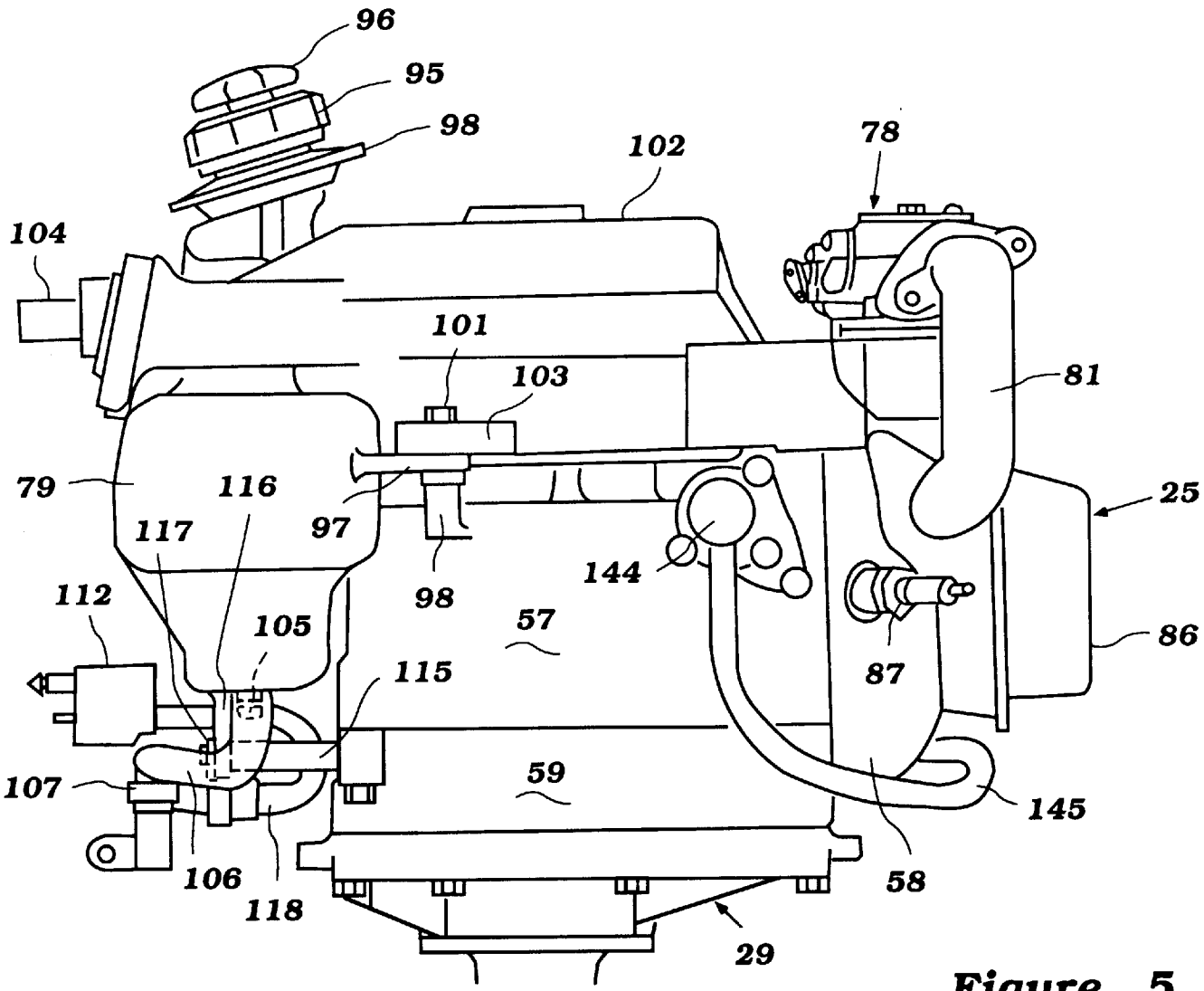
FIG. 5 is a side elevational view looking in the same direction as FIG. 4, but showing only the outer peripheral configuration of the powering internal combustion engine.
Figure 7:
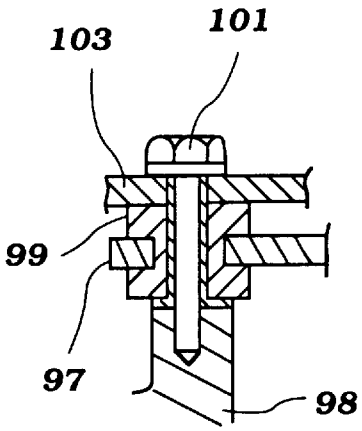
FIG. 7 is an enlarged cross-sectional view showing one of the supports for the fuel tank.
Figure 6:
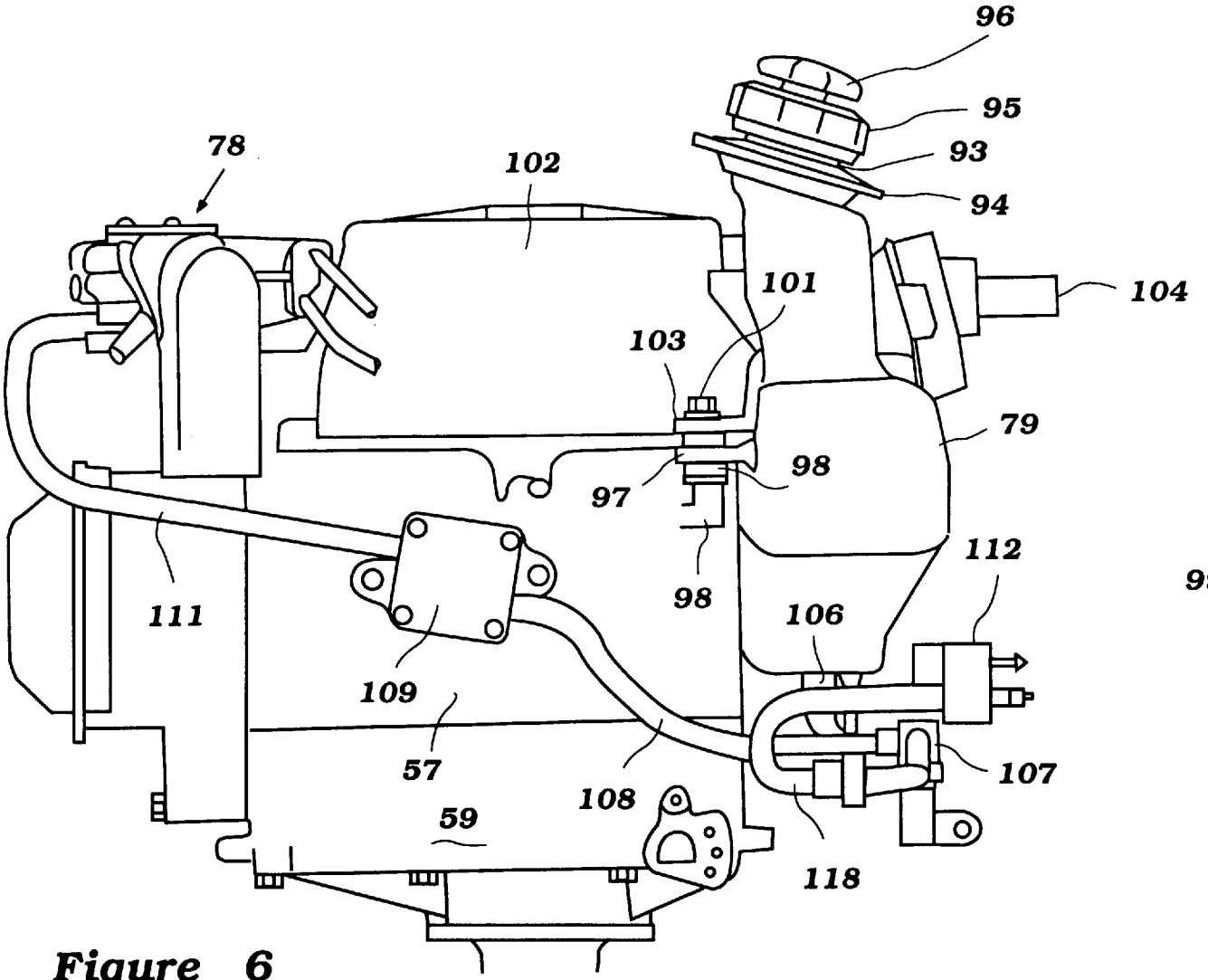
FIG. 6 is a side elevational view of the engine looking from the side opposite to FIG. 5.

The charge which has been admitted to the combustion chamber recess 72 will be compressed when the piston 69 moves upwardly and then fired at an appropriate time by an ignition system including a spark plug 87 (FIG. 5). The burnt charge is exhausted through an exhaust valve seat which is valved by a poppet type exhaust valve 88. Like the intake valve 83, the exhaust valve 88 is suitably supported in the valve chamber of cylinder head 58 and is urged to its closed position by a coil compression spring 89. A rocker arm 91 is associated with the exhaust valve 88 for operating it in a known manner.

When opened, the exhaust gases can exit the combustion chamber through an exhaust passage 92 that is formed in the cylinder head 86. As seen best in FIG. 4, the exhaust passage 92 extends through a lower face of the cylinder head 58. There it communicates with an exhaust system formed in initial part by the crankcase forming member 59. This exhaust system will be described shortly.

The fuel supply system for supplying the fuel to the carburetor 78 from the fuel tank 79 and for permitting filling and charging of the fuel tank 79 will be now described by principle reference to FIGS. 4 through 7. First, it will be seen that the fuel tank 79 has a filler neck portion 93 which extends upwardly toward an opening in the main cowling member 27. A sealing gasket 94 provides a seal between the fill neck 93 and the cowling member 27.

A fill cap 95 is threadedly connected to the upper end of the fill neck 93 externally of the protective cowling member 27. This fuel cap 95 also has an air vent valve 96.

The fuel tank 79 has a pair of spaced apart boss sections 97 formed on its opposite sides which are juxtaposed to respective lugs 98 formed on the cylinder block member 57. Elastic grommets 99 (FIG. 7) are interposed between the lugs 97 and 98 and threaded fasteners 101 that mount the fuel tank 79 to the cylinder block 57.

In addition, a recoil starter cover 102 also has lugs 103 that are affixed to the cylinder block 97 by the same threaded fasteners 101. This recoil starter has assembly 102 has a pull handle 104 that is accessible from the exterior of the protective cowling member 27 for pull starting of the engine 25 in a well known member. In addition, a fly wheel magneto (not shown) may be also associated with the pull starter for generating electrical power for firing the spark plugs 87.

Continuing to refer to the fuel supply system, the fuel tank 79 has a discharge port 105 that communicates with a first supply conduit 106. This conduit 106 is connected to a combined shut off, drain valve 107 which, in turn, communicates with a supply line 108. This supply line 108 extends to an engine driven fuel pump 109. The fuel pump 109 will deliver fuel under pressure to the carburetor 78 through a supply conduit 111.

Since the fuel tank 79 is mounted within the protective cowling, it will have a relatively small volume. Therefore, an external source of fuel may also be provided for supplying fuel to the engine. This external supply includes a quick disconnect coupling 112 that is mounted on the tray 26 as best seen in FIG. 4. This coupling 112 includes a quick disconnect shut off valve 113 and a locating pin 114 so as to cooperate with a female coupling that can be connected to a remote fuel tank in a well known manner.

This assembly coupling and valve assembly is further mounted on a mounting boss 115 of the oil pan forming member 59 by means of a mounting bracket 116 and threaded fastener 117. A conduit 118 connects the quick disconnect coupling 112 with the shut off and drain valve 107 and, accordingly, with the tank 79.

It has been noted that the exhaust gases from the cylinder head exhaust port 92 are discharged to the atmosphere through an exhaust system. That exhaust system will now be described by primary reference to FIGS. 3, 4 and 8 through 11. Initial reference will be made to FIGS. 3 and 8 through 11, which describe the structure by which the exhaust gases are collected from the cylinder head exhaust passage 92 and are delivered to an elongated expansion chamber 119 that is formed in major part in the tubular portion 41 of the drive shaft housing and lower unit outer housing 29.

It has already been noted that the cylinder head assembly 58 is detachably connected to the crankcase forming member 59. This crankcase forming member 59 is formed with an exhaust collector passage 119 in one side thereof, as best seen in FIGS. 6 and 9 through 11. This exhaust collector passage 119 has an inlet portion that communicates with the discharge end of the cylinder head exhaust passage 92 and then curves downwardly. This is disposed to one side of the oil reservoir portion 63 of this member 59. The member 59 has an upper surface 122 that is affixed in sealing relationship with a downwardly facing surface of the cylinder block 57 and particularly the portion that forms the upper crankcase chamber 61.

It should be noted that oil is maintained in the reservoir 63. A suitable splash type lubricating system may be incorporated for delivering this oil to the various components of the engine 25. The crankcase chamber forming member 59 also has a cylindrical center boss 123 in which the bearing 66 is supported.

It will be seen that the lower face 124 of the crankcase forming member 59 is formed with a pair of rib-like portions 125 and 126 that define a path for the exhaust gases. These rib-like portions 125 and 126 cooperate with respective rib-like portions 127 and 128 formed in the upper portion of the supporting plate section 39 of the drive shaft housing 29 as best seen in FIG. 8.

Figure 8:
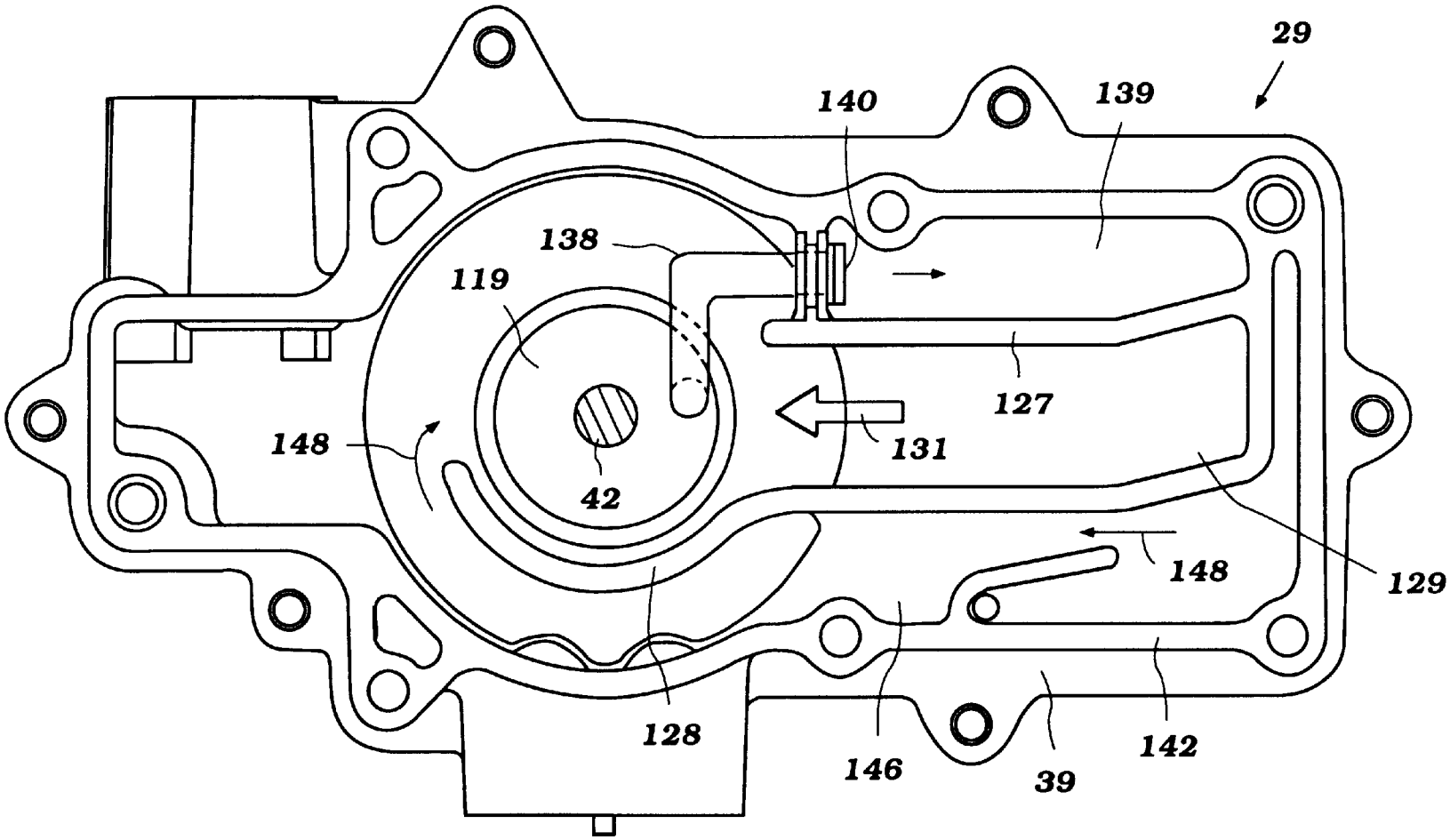
FIG. 8 is a top plan view showing the support plate portion of the drive shaft housing for the engine in the power head.
Figure 9:
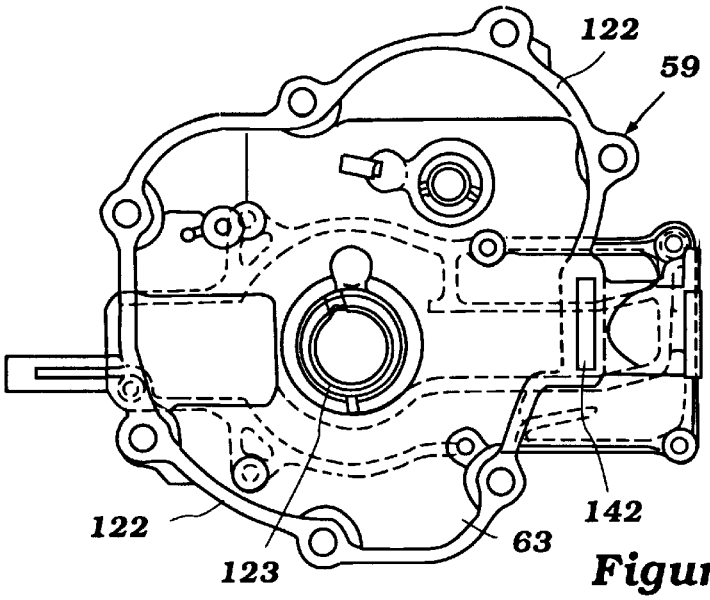
FIG. 9 is a top plan view showing the configuration of a portion of the crankcase chamber forming member and specifically the oil reservoir therefore.
Figure 10:
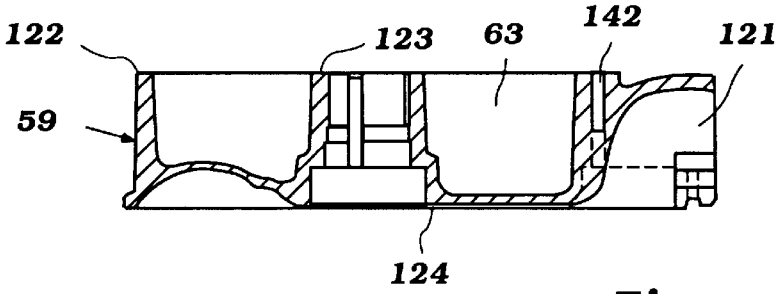
FIG. 10 is a cross-sectional view of this component.
Figure 11:
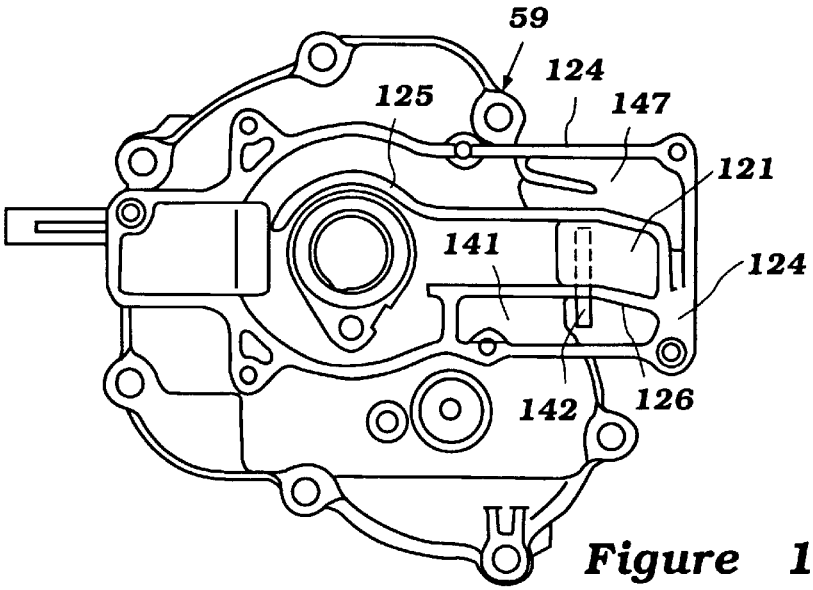
FIG. 11 is a bottom plan view of this component.

These cooperating rib-like portions 125 and 128 and 126 and 127 define an exhaust passageway 129 so that the exhaust gases will flow as shown by the arrow 131 in FIG. 8 toward the expansion chamber opening 119 formed by the drive shaft housing cylindrical portion 41.

After flowing through the aforenoted relatively restricted path, the exhaust gases can expand in the expansion chamber volume 119 to provide a silencing effect. The exhaust gases then are discharged to the atmosphere through a path which is shown best in FIGS. 2 and 3.

It should be noted that the lower unit housing 35 also is provided with an expansion chamber portion 132 in which a further expansion of the exhaust gases may take place. The lower unit 35 is provided with an under water exhaust gas discharge 133 from which these exhaust gases may exit. This occurs when the watercraft is in a planing condition and this discharge 133 is relatively shallowly submerged.

However, when operating at idle or when the watercraft is stationary and the engine running as shown in FIG. 1, this discharge opening 133 will be deeply submerged. Also, the pressure of the exhaust gases will be relatively low. Thus, there is provided a low speed exhaust gas discharge path that is less restricted under this condition but which will also provide added silencing. This system is shown best in FIG. 3.

As may be seen in this figure, the tubular portion 41 of the drive shaft housing 29 is provided with a restricted exhaust gas discharge opening 134. This opening 134 is positioned proximately to the lower steering support of the drive shaft housing 29 provided by the elastic member 47. From this opening 134, the exhaust gases may pass into the aforenoted expansion chamber 44 formed in the area between the swivel bracket portion 43 and the cylindrical portion 41 of the drive shaft housing 29. Thus, a further expansion will occur that will assist in the silencing.

An upper portion of the swivel bracket 28 is provided with an above the water exhaust gas discharge opening 135 through which these exhaust gases may pass to the atmosphere. Thus, even when operating at low speeds, there will be an effective discharge of the exhaust gases and silencing of them. However, when traveling at high speeds, the size of the discharge openings 134 and 135 will restrict any substantial flow of exhaust gases from this low speed path.

It has been noted that the engine 25 is water cooled. That water cooling system will now be described by principle reference to FIGS. 1, 3 and 8 through 12. Also, the following description will explain how the water cooling system cooperates with the oil reservoir 63 and the exhaust system so as to assist in maintaining the engine and its fluids at the correct temperature and also so as to assist in the exhaust silencing.

First, it should be noted that the lower unit housing portion 35 is provided with a gill-like opening 136 (FIG. 1) through which water may be drawn by a water pump 137 (FIG. 2) that is driven off of the drive shaft 42 in a well-known manner. This water under pressure is then pumped upwardly through a water delivery tube 138 that passes through the drive shaft housing cylindrical portion 41.

Figure 12:
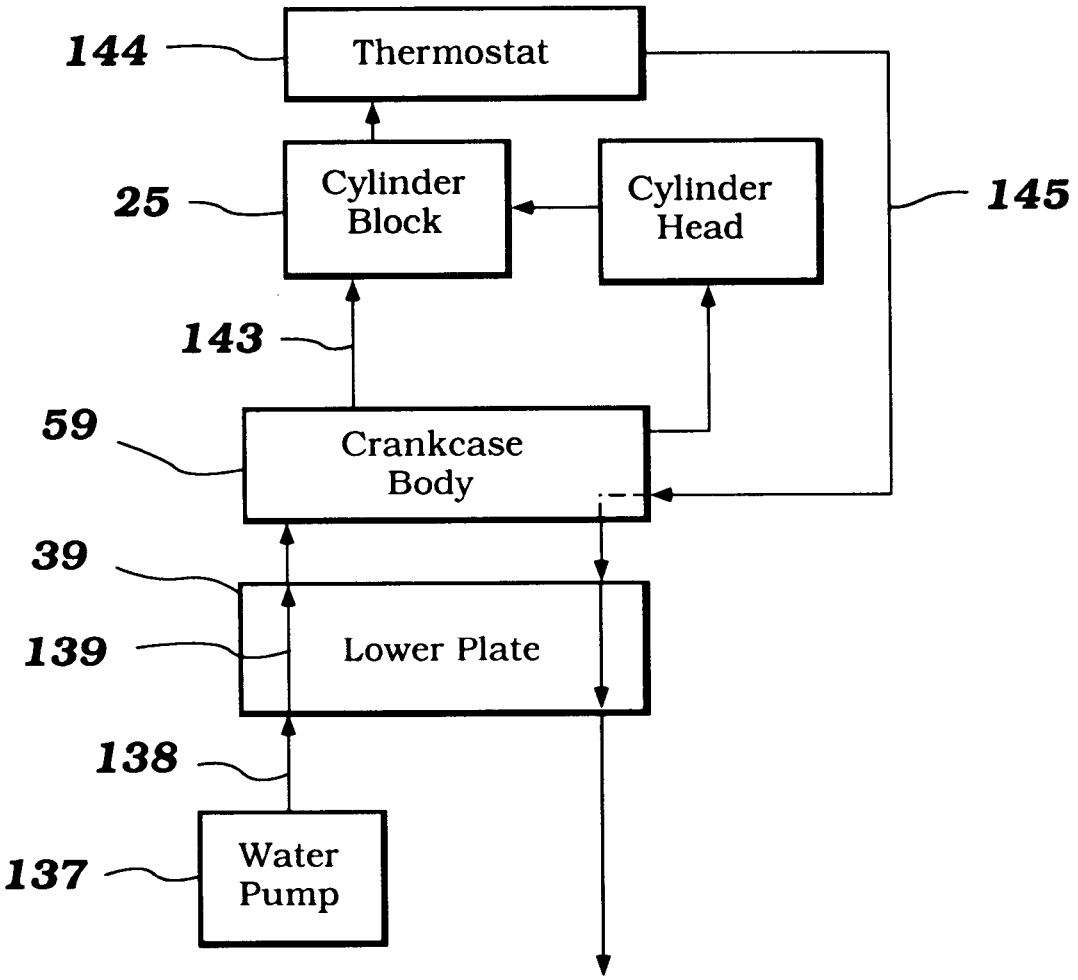
FIG. 12 is a schematic view showing the flow of cooling water through the outboard motor and its return back to the body of water in which the watercraft is operating.

As shown schematically in FIG. 12 and in actual construction in FIG. 8, this coolant is then delivered to a cooling jacket portion 139 that is formed in the upper surface of the drive shaft housing supporting plate portion 39. The conduit 138 has a discharge fitting 140 that communicates with this portion 139. It should be noted that the portion 139 is formed by the rib 127 that defines the exhaust gas passage 129 and the upper surface 142 of this drive shaft housing portion 139.

Flow of water through the portion 139 also communicates with a water supply path 141 (FIG. 11) formed by the lower portion of the crankcase forming member 59. This oil pan forming member water passage 141, in turn, communicates with a slotted passage 142 that extends upwardly and which communicates with an inlet opening formed in a cylinder block cooling jacket portion which is shown best in FIG. 4 and which is identified by the reference numeral 143. Thus, water can flow from this member directly into the cylinder block cooling jacket 143 and also into a communicating cooling jacket of the cylinder head 58.

As seen in FIG. 5, a thermostat housing and thermostat assembly 144, which is shown schematically in FIG. 12, permits the discharge of coolant from the cylinder block and cylinder head cooling jackets back to a discharge passageway formed in the crankcase forming member 59 and supporting plate portion 39 of the drive shaft housing 28. This includes an external return conduit 145.

This return conduit 145 communicates with a water return passageway 146 formed in the drive shaft housing support plate portion 39 and which is closed by a cooperating passage portion 147 formed in the lower surface of the oil pan forming member 59. This return water path, indicated by the arrows 148 flows along the opposite side of the exhaust passage 129 and thus further assists in the cooling of the exhaust gases.

This water is then dumped into the expansion chamber area 119 of the drive shaft housing cylindrical portion 41 for discharge back to the body of water in which the watercraft is operating through the under water exhaust gas discharge 133. This water will drain through this path under all running conditions since back pressure is not a problem with respect to the water discharge.

The mechanism for shifting the transmission 36 will finally be described by reference to FIGS. 2, 3 and 4. A shift lever 149 is pivotally supported on the supporting plate portion 39 of the drive shaft housing 29. This lever 149 is operated by a suitable, externally positioned shift lever. A shift link 151 is pivotally connected to an arm of the shift lever 149. This shift link 151 depends into the drive shaft housing portion 34 and lower unit 35 to operate a shift cam (not shown) that operates the dog clutches of the transmission 36 in a well known manner.

Thus, it should be readily apparent from the foregoing description that the described system provides a very effective exhaust gas silencing, a simple structure for forming the various exhaust passages which minimizes the number of seals that may meet the form, and also which provides a very effective flow of coolant to and from the engine while cooling not only the exhaust gases but also the oil pan. Of course, the foregoing description is that of a preferred embodiment of the invention and various changes and modifications may be made without departing from the spirit and scope of the invention, as defined by the appended claims.

I claim:

1. An outboard motor that is comprised of a power head containing an internal combustion engine and a surrounding protective cowling, a drive shaft housing and lower unit depending from said power head and journaling a drive shaft driven by an engine crankshaft and a propulsion device for propelling an associated watercraft, said engine being comprised of a cylinder block member, a cylinder head and an oil pan forming member, said cylinder block member defining an upper part of a crankcase chamber in which said crankshaft is rotatably journaled and a cylinder bore closed at one end by said crankcase chamber and at the other end by said cylinder head, said cylinder head defining an exhaust passage that terminates in an exhaust port in an outer surface of said cylinder head, said oil pan forming member integrally forming an oil reservoir and the lower part of said crankcase chamber and an exhaust passage that receives at least some of the exhaust gasses from said cylinder head exhaust passage, said cylinder block member having an integral cooling jacket extending at least in part around said cylinder bore, and cooling passage means formed integrally in said oil pan forming member for delivering cooling water to said cylinder block member cooling jacket and discharging cooling water at least in part from said cylinder block member cooling jacket through said oil pan forming member in proximity to both said oil reservoir and said exhaust passage formed therein.

2. An outboard motor as set forth in claim 1 further including a closure member fixed to the underside of said oil pan forming member.

3. An outboard motor as set forth in claim 2 wherein the cylinder head member is also affixed to the oil pan forming member.

4. An outboard motor as set forth in claim 3 wherein the cylinder head exhaust port communicates with an exhaust system formed in the drive shaft housing and lower unit through the exhaust passage.

5. An outboard motor as set forth in claim 4 wherein the oil pan forming member and the exhaust passage are disposed to one side of the cylinder bore and wherein the cylinder head exhaust passage exits the cylinder head at a surface that extends to said one side of said cylinder bore for communication with the exhaust passage.

6. An outboard motor as set forth in claim 5 wherein the exhaust gases are discharged to the atmosphere through an underwater exhaust gas discharge formed in the lower unit and an above the water exhaust gas discharge formed at least in part in the drive shaft housing.

7. An outboard motor as set forth in claim 1 wherein the cooling passage means comprises a delivery passage extending along one side of the exhaust passage and a return passage extending along the other side of said exhaust passage.

8. An outboard motor as set forth in claim 7 wherein the delivery passage receives its water contiguous to the oil reservoir.

9. An outboard motor as set forth in claim 8 wherein said return passage discharges its water contiguous to the oil reservoir.

10. An outboard motor as set forth in claim 9 wherein discharged water is mixed with the exhaust gasses at the point where the exhaust gases are introduced to an exhaust system formed in the drive shaft housing and lower unit.

11. An outboard motor as set forth in claim 10 further including a closure member fixed to the underside of said oil pan forming member.

12. An outboard motor as set forth in claim 11 wherein the cylinder head member is also affixed to the oil pan forming member.

13. An outboard motor as set forth in claim 12 wherein the exhaust system is formed in the drive shaft housing and lower unit.

14. An outboard motor as set forth in claim 13 wherein the oil pan forming member and the exhaust passage are disposed to one side of the cylinder bore and wherein the cylinder head exhaust passage exits the cylinder head at a surface that extends to said one side of said cylinder bore for communication with the exhaust passage.

15. An outboard motor as set forth in claim 14 wherein the exhaust gases are discharged to the atmosphere through an underwater exhaust gas discharge formed in the lower unit and an above the water exhaust gas discharge formed at least in part in the drive shaft housing.

* * * * *